US010076824B2

(12) United States Patent
Shen et al.

(10) Patent No.: US 10,076,824 B2
(45) Date of Patent: Sep. 18, 2018

(54) POLYCRYSTALLINE DIAMOND CONSTRUCTION WITH CONTROLLED GRADIENT METAL CONTENT

(71) Applicant: Smith International, Inc., Houston, TX (US)

(72) Inventors: Yuelin Shen, Houston, TX (US); Youhe Zhang, Spring, TX (US); Guodong Zhan, Spring, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 112 days.

(21) Appl. No.: 15/083,281

(22) Filed: Mar. 28, 2016

(65) Prior Publication Data

US 2016/0229031 A1 Aug. 11, 2016

Related U.S. Application Data

(62) Division of application No. 11/958,314, filed on Dec. 17, 2007, now Pat. No. 9,297,211.

(51) Int. Cl.
*B22F 7/06* (2006.01)
*B24D 3/10* (2006.01)
(Continued)

(52) U.S. Cl.
CPC ..... *B24D 3/10* (2013.01); *B22F 7/06* (2013.01); *C22C 26/00* (2013.01); *E21B 10/567* (2013.01);
(Continued)

(58) Field of Classification Search
CPC .... B22F 7/06; B22F 2005/001; E21B 10/567; E21B 10/5735; E21B 10/573
See application file for complete search history.

(56) References Cited

U.S. PATENT DOCUMENTS 2,941,241 A 6/1960 Strong
2,941,248 A 6/1960 Hall
(Continued)

FOREIGN PATENT DOCUMENTS

EP 0196777 A1 10/1986
EP 246789 A2 11/1987
(Continued)

OTHER PUBLICATIONS

Office Action issued in U.S. Appl. No. 12/505,316 dated Jul. 6, 2011, 12 pages.
(Continued)

*Primary Examiner* — Kipp Charles Wallace

(57) ABSTRACT

Polycrystalline diamond constructions comprises a diamond body attached to a metallic substrate, and having an engineered metal content. The body comprises bonded together diamond crystals with a metal material disposed interstitially between the crystals. A body working surface has metal content of 2 to 8 percent that increases moving away therefrom. A transition region between the body and substrate includes metal rich and metal depleted regions having controlled metal content that provides improved thermal expansion matching/reduced residual stress. A point in the body adjacent the metal rich zone has a metal content that is at least about 3 percent by weight greater than that at a body/substrate interface. The metal depleted zone metal content increases gradually moving from the body, and has a thickness greater than 1.25 mm. Metal depleted zone metal content changes less about 4 percent per millimeter moving along the substrate.

18 Claims, 5 Drawing Sheets

(51) Int. Cl.

| | |
|---|---|
| ***C22C 26/00*** | (2006.01) |
| ***E21B 10/567*** | (2006.01) |
| ***E21B 10/573*** | (2006.01) |
| *B22F 5/00* | (2006.01) |
| *B24D 18/00* | (2006.01) |

(52) U.S. Cl.

CPC .... *E21B 10/5735* (2013.01); *B22F 2005/002* (2013.01); *B22F 2999/00* (2013.01); *B24D 18/0009* (2013.01)

(56) References Cited

U.S. PATENT DOCUMENTS

| | | | |
|---|---|---|---|
| 2,947,611 | A | 8/1960 | Bundy |
| 3,136,615 | A | 6/1964 | Bovenkerk et al. |
| 3,141,746 | A | 7/1964 | De Lai |
| 3,233,988 | A | 2/1966 | Wentorf, Jr. et al. |
| 3,609,818 | A | 10/1971 | Wentorf, Jr. |
| 3,745,623 | A | 7/1973 | Wentorf, Jr. et al. |
| 3,767,371 | A | 10/1973 | Wentorf, Jr. et al. |
| 4,104,344 | A | 8/1978 | Pope et al. |
| 4,108,614 | A | 8/1978 | Mitchell |
| 4,151,686 | A | 5/1979 | Lee et al. |
| 4,224,380 | A | 9/1980 | Bovenkerk et al. |
| 4,255,165 | A | 3/1981 | Dennis et al. |
| 4,268,276 | A | 5/1981 | Bovenkerk |
| 4,288,248 | A | 9/1981 | Bovenkerk et al. |
| 4,289,503 | A | 9/1981 | Corrigan |
| 4,303,442 | A | 12/1981 | Hara et al. |
| 4,311,490 | A | 1/1982 | Bovenkerk et al. |
| 4,373,593 | A | 2/1983 | Phaal et al. |
| 4,387,287 | A | 6/1983 | Marazzi |
| 4,403,015 | A | 9/1983 | Nakai et al. |
| 4,412,980 | A | 11/1983 | Tsuji et al. |
| 4,481,016 | A | 11/1984 | Campbell et al. |
| 4,486,286 | A | 12/1984 | Lewin et al. |
| 4,504,519 | A | 3/1985 | Zelez |
| 4,505,746 | A | 3/1985 | Nakai et al. |
| 4,522,633 | A | 6/1985 | Dyer |
| 4,525,178 | A | 6/1985 | Hall |
| 4,525,179 | A | 6/1985 | Gigl |
| 4,534,773 | A | 8/1985 | Phaal et al. |
| 4,556,403 | A | 12/1985 | Almond et al. |
| 4,560,014 | A | 12/1985 | Geczy |
| 4,570,726 | A | 2/1986 | Hall |
| 4,572,722 | A | 2/1986 | Dyer |
| 4,604,106 | A | 8/1986 | Hall |
| 4,605,343 | A | 8/1986 | Hibbs et al. |
| 4,606,738 | A | 8/1986 | Hayden |
| 4,621,031 | A | 11/1986 | Scruggs |
| 4,629,373 | A | 12/1986 | Hall |
| 4,636,253 | A | 1/1987 | Nakai et al. |
| 4,645,977 | A | 2/1987 | Kurokawa et al. |
| 4,662,348 | A | 5/1987 | Hall et al. |
| 4,664,705 | A | 5/1987 | Horton et al. |
| 4,670,025 | A | 6/1987 | Pipkin |
| 4,673,414 | A | 6/1987 | Lavens et al. |
| 4,690,691 | A | 9/1987 | Komanduri |
| 4,694,918 | A | 9/1987 | Hall |
| 4,707,384 | A | 11/1987 | Schachner et al. |
| 4,726,718 | A | 2/1988 | Meskin et al. |
| 4,766,040 | A | 8/1988 | Hillert et al. |
| 4,776,861 | A | 10/1988 | Frushour |
| 4,784,023 | A | 11/1988 | Dennis |
| 4,792,001 | A | 12/1988 | Zijsling |
| 4,793,828 | A | 12/1988 | Burnand |
| 4,797,241 | A | 1/1989 | Peterson et al. |
| 4,802,539 | A | 2/1989 | Hall et al. |
| 4,807,402 | A | 2/1989 | Rai |
| 4,828,582 | A | 5/1989 | Frushour |
| 4,844,185 | A | 7/1989 | Newton et al. |
| 4,850,523 | A | 7/1989 | Slutz |
| 4,854,405 | A | 8/1989 | Stroud |
| 4,861,350 | A | 8/1989 | Phaal et al. |
| 4,861,673 | A | 8/1989 | Hara et al. |
| 4,871,377 | A | 10/1989 | Frushour |
| 4,882,128 | A | 11/1989 | Hukvari et al. |
| 4,899,922 | A | 2/1990 | Slutz et al. |
| 4,919,220 | A | 4/1990 | Fuller et al. |
| 4,931,068 | A | 6/1990 | Dismukes et al. |
| 4,933,529 | A | 6/1990 | Saville |
| 4,940,180 | A | 7/1990 | Martell |
| 4,943,488 | A | 7/1990 | Sung et al. |
| 4,944,772 | A | 7/1990 | Cho |
| 4,954,139 | A | 9/1990 | Cerutti |
| 4,976,324 | A | 12/1990 | Tibbitts |
| 4,984,642 | A | 1/1991 | Renard et al. |
| 4,987,800 | A | 1/1991 | Gasan et al. |
| 4,991,467 | A | 2/1991 | Packer |
| 5,011,514 | A | 4/1991 | Cho et al. |
| 5,011,515 | A | 4/1991 | Frushour |
| 5,027,912 | A | 7/1991 | Juergens |
| 5,030,276 | A | 7/1991 | Sung et al. |
| 5,032,147 | A | 7/1991 | Frushour |
| 5,068,148 | A | 11/1991 | Nakahara et al. |
| 5,092,687 | A | 3/1992 | Hall |
| 5,096,465 | A | 3/1992 | Chen et al. |
| 5,116,568 | A | 5/1992 | Sung et al. |
| 5,127,923 | A | 7/1992 | Bunting et al. |
| 5,135,061 | A | 8/1992 | Newton, Jr. |
| 5,176,720 | A | 1/1993 | Martell et al. |
| 5,186,725 | A | 2/1993 | Martell et al. |
| 5,193,948 | A | 3/1993 | Noggle |
| 5,199,832 | A | 4/1993 | Meskin et al. |
| 5,205,684 | A | 4/1993 | Meskin et al. |
| 5,213,248 | A | 5/1993 | Horton et al. |
| 5,238,074 | A | 8/1993 | Tibbitts et al. |
| 5,264,283 | A | 11/1993 | Waldenstrom et al. |
| 5,304,342 | A | 4/1994 | Hall et al. |
| 5,337,844 | A | 8/1994 | Tibbitts |
| 5,351,772 | A | 10/1994 | Smith et al. |
| 5,355,696 | A | 10/1994 | Briggs |
| 5,355,969 | A | 10/1994 | Hardy et al. |
| 5,369,034 | A | 11/1994 | Hargett |
| 5,370,195 | A | 12/1994 | Keshavan et al. |
| 5,379,853 | A | 1/1995 | Lockwood et al. |
| 5,439,492 | A | 8/1995 | Anthony et al. |
| 5,464,068 | A | 11/1995 | Najafi-Sani |
| 5,468,268 | A | 11/1995 | Tank et al. |
| 5,469,927 | A | 11/1995 | Griffin |
| 5,494,477 | A | 2/1996 | Flood et al. |
| 5,496,638 | A | 3/1996 | Waldenstrom et al. |
| 5,505,748 | A | 4/1996 | Tank et al. |
| 5,510,193 | A | 4/1996 | Cerutti et al. |
| 5,523,121 | A | 6/1996 | Anthony et al. |
| 5,524,719 | A | 6/1996 | Dennis |
| 5,560,716 | A | 10/1996 | Tank et al. |
| 5,564,511 | A | 10/1996 | Frushour |
| 5,603,070 | A | 2/1997 | Cerutti et al. |
| 5,605,198 | A | 2/1997 | Tibbitts et al. |
| 5,607,024 | A | 3/1997 | Keith et al. |
| 5,620,382 | A | 4/1997 | Cho et al. |
| 5,624,068 | A | 4/1997 | Waldenstrom et al. |
| 5,645,617 | A | 7/1997 | Frushour |
| 5,667,028 | A | 9/1997 | Truax et al. |
| 5,718,948 | A | 2/1998 | Ederyd et al. |
| 5,722,497 | A | 3/1998 | Gum et al. |
| 5,722,499 | A | 3/1998 | Nguyen et al. |
| 5,766,394 | A | 6/1998 | Anderson et al. |
| 5,776,615 | A | 7/1998 | Wong et al. |
| 5,780,139 | A | 7/1998 | Carter et al. |
| 5,820,985 | A | 10/1998 | Chow et al. |
| 5,833,021 | A | 11/1998 | Mensa-Wilmot et al. |
| 5,853,873 | A | 12/1998 | Kukino et al. |
| 5,862,873 | A | 1/1999 | Matthias et al. |
| 5,875,862 | A | 3/1999 | Jurewicz et al. |
| 5,887,580 | A | 3/1999 | Eyre |
| 5,889,219 | A | 3/1999 | Moriguchi et al. |
| 5,897,942 | A | 4/1999 | Karner et al. |
| 5,906,245 | A | 5/1999 | Tibbitts et al. |
| 5,935,323 | A | 8/1999 | Tanga et al. |
| 5,954,147 | A | 9/1999 | Overstreet et al. |
| 5,979,578 | A | 11/1999 | Packer |
| 6,009,963 | A | 1/2000 | Chaves et al. |

(56) References Cited

U.S. PATENT DOCUMENTS 6,041,875 A 3/2000 Rai et al.
6,054,693 A 4/2000 Barmatz et al.
6,063,333 A 5/2000 Dennis
6,068,913 A 5/2000 Cho et al.
6,098,730 A 8/2000 Scott et al.
6,106,585 A 8/2000 Packer et al.
6,123,612 A 9/2000 Goers
6,126,741 A 10/2000 Jones et al.
6,131,678 A 10/2000 Griffin
6,132,675 A 10/2000 Corrigan et al.
6,165,616 A 12/2000 Lemelson et al.
6,193,001 B1 2/2001 Eyre et al.
6,196,341 B1 3/2001 Chaves
6,202,770 B1 3/2001 Jurewicz et al.
6,209,185 B1 4/2001 Scott
6,216,805 B1 4/2001 Lays et al.
6,220,375 B1 4/2001 Butcher et al.
6,234,261 B1 5/2001 Evans et al.
6,248,447 B1 6/2001 Griffin et al.
6,258,139 B1 7/2001 Jensen
6,269,894 B1 8/2001 Griffin
6,298,930 B1 10/2001 Sinor et al.
6,302,225 B1 10/2001 Yoshida et al.
6,314,836 B1 11/2001 Einset et al.
6,315,065 B1 11/2001 Yong et al.
6,332,503 B1 12/2001 Pessier et al.
6,344,149 B1 2/2002 Oles
6,367,568 B2 4/2002 Steinke et al.
6,410,085 B1 6/2002 Griffen et al.
6,435,058 B1 8/2002 Matthias et al.
6,443,248 B2 9/2002 Yong et al.
6,447,560 B2 9/2002 Jensen et al.
6,447,843 B1 9/2002 Olson
6,544,308 B2 4/2003 Griffin et al.
6,550,556 B2 4/2003 Middlemiss et al.
6,562,462 B2 5/2003 Griffin et al.
6,575,350 B2 6/2003 Evans et al.
6,585,064 B2 7/2003 Griffin et al.
6,589,640 B2 7/2003 Griffin et al.
6,592,985 B2 7/2003 Griffin et al.
6,601,662 B2 8/2003 Matthias et al.
6,605,798 B1 8/2003 Cullen
6,641,861 B2 11/2003 Saito et al.
6,655,845 B1 12/2003 Pope et al.
6,739,214 B2 5/2004 Griffin et al.
6,744,024 B1 6/2004 Hayes et al.
6,749,033 B2 6/2004 Griffin et al.
6,797,326 B2 9/2004 Griffin et al.
6,830,598 B1 12/2004 Sung
6,846,341 B2 1/2005 Middlemiss
6,852,414 B1 2/2005 Frushour
6,861,137 B2 3/2005 Griffin et al.
6,892,836 B1 5/2005 Eyre et al.
6,904,984 B1 6/2005 Estes et al.
6,935,444 B2 8/2005 Lund et al.
6,991,049 B2 1/2006 Eyre et al.
7,077,867 B1 7/2006 Pope et al.
7,108,598 B1 9/2006 Galloway
7,316,279 B2 1/2008 Wiseman et al.
7,350,601 B2 4/2008 Belnap et al.
7,377,341 B2 5/2008 Middlemiss et al.
7,464,973 B1 12/2008 Chapman et al.
7,464,993 B2 12/2008 Hall et al.
7,493,973 B2 2/2009 Keshavan et al.
7,517,589 B2 4/2009 Eyre
7,568,770 B2 8/2009 Hall et al.
7,635,035 B1 12/2009 Bertagnolli et al.
7,942,219 B2 5/2011 Keshavan et al.
8,002,859 B2 8/2011 Griffo et al.
8,028,771 B2 10/2011 Keshavan
8,066,087 B2 11/2011 Griffo et al.
8,138,191 B2 3/2012 Danter et al.
8,172,012 B2 5/2012 Achilles
8,172,916 B2 5/2012 Fujimura et al.
8,236,074 B1 8/2012 Bertagnolli et al.
8,328,891 B2 12/2012 Zhang et al.
8,567,531 B2 10/2013 Belnap et al.
8,771,389 B2 7/2014 Keshavan et al.
8,783,389 B2 7/2014 Fan et al.
2001/0008190 A1 7/2001 Scott et al.
2001/0030067 A1 10/2001 Evans et al.
2001/0054332 A1 12/2001 Cheynet De Beaupre et al.
2002/0034631 A1 3/2002 Griffin et al.
2002/0034632 A1 3/2002 Griffin et al.
2002/0045059 A1 4/2002 Griffin et al.
2002/0071729 A1 6/2002 Middlemiss et al.
2002/0084112 A1 7/2002 Hall et al.
2003/0235691 A1 12/2003 Griffin et al.
2004/0062928 A1 4/2004 Raghavan et al.
2004/0094333 A1 5/2004 Yamamoto et al.
2004/0105806 A1 6/2004 Griffin et al.
2004/0244540 A1 12/2004 Oldham et al.
2005/0050801 A1 3/2005 Cho et al.
2005/0129950 A1 6/2005 Griffin et al.
2005/0133277 A1 6/2005 Dixon
2005/0210755 A1 9/2005 Cho et al.
2005/0230156 A1 10/2005 Belnap et al.
2005/0262774 A1 12/2005 Eyre et al.
2005/0263328 A1 12/2005 Middlemiss
2006/0060390 A1 3/2006 Eyre
2006/0110575 A1 5/2006 Rosiwal et al.
2006/0060392 A1 6/2006 Eyre
2006/0157285 A1 7/2006 Cannon et al.
2006/0162969 A1 7/2006 Belnap et al.
2006/0165993 A1 7/2006 Keshavan
2006/0191723 A1 8/2006 Keshavan
2006/0207802 A1 9/2006 Zhang et al.
2006/0247769 A1 11/2006 Molz et al.
2006/0266558 A1 11/2006 Middlemiss et al.
2006/0266559 A1 11/2006 Keshavan et al.
2006/0283639 A1 12/2006 Yong et al.
2007/0029114 A1 2/2007 Middlemiss
2007/0079994 A1 4/2007 Middlemiss
2007/0169419 A1 7/2007 Davies et al.
2007/0181348 A1 8/2007 Lancaster et al.
2007/0187155 A1 8/2007 Middlemiss
2008/0029310 A1 2/2008 Stevens et al.
2008/0085407 A1 4/2008 Cooley et al.
2008/0115421 A1 5/2008 Sani
2008/0142276 A1 6/2008 Griffo et al.
2008/0178535 A1 7/2008 Wan
2008/0185189 A1 8/2008 Griffo et al.
2008/0206576 A1 8/2008 Qian et al.
2008/0223621 A1 9/2008 Middlemiss et al.
2008/0223623 A1 9/2008 Keshavan et al.
2008/0230280 A1 9/2008 Keshavan et al.
2008/0240879 A1 10/2008 Dourfaye et al.
2008/0250723 A1 10/2008 Fragiacomo
2008/0302579 A1 12/2008 Keshavan et al.
2009/0032169 A1 2/2009 Dourfaye et al.
2009/0090563 A1 4/2009 Voronin et al.
2009/0133938 A1 5/2009 Hall et al.
2009/0152017 A1 6/2009 Shen et al.
2009/0152018 A1 6/2009 Sani
2009/0173015 A1 7/2009 Keshavan et al.
2009/0226688 A1 9/2009 Fang
2009/0313908 A1 12/2009 Zhang et al.
2010/0012389 A1 1/2010 Zhang et al.
2010/0015140 A1 1/2010 Daunter et al.
2010/0181117 A1 7/2010 Scott
2010/0281782 A1 11/2010 Keshavan et al.
2010/0294571 A1 11/2010 Belnap et al.
2010/0320006 A1 12/2010 Fan et al.
2011/0023375 A1 2/2011 Sani et al.
2012/0222364 A1 9/2012 Lyons et al.
2012/0225277 A1 9/2012 Scott
2013/0291442 A9 3/2013 Zhang et al.
2014/0290146 A1 10/2014 Fan et al.

FOREIGN PATENT DOCUMENTS

EP 0291314 A2 11/1988
EP 0300699 A2 1/1989
EP 0329954 A2 8/1989

(56) References Cited

FOREIGN PATENT DOCUMENTS

| | | | |
|---|---|---|---|
| EP | 0352811 | A1 | 1/1990 |
| EP | 0500253 | A1 | 8/1992 |
| EP | 0543461 | A2 | 5/1993 |
| EP | 585631 | A1 | 3/1994 |
| EP | 0595630 | A1 | 5/1994 |
| EP | 0612868 | A1 | 8/1994 |
| EP | 0617207 | A2 | 9/1994 |
| EP | 0714695 | A2 | 6/1996 |
| EP | 0787820 | A2 | 8/1997 |
| EP | 0860515 | A1 | 8/1998 |
| EP | 1036913 | A1 | 9/2000 |
| EP | 1064991 | A1 | 1/2001 |
| EP | 1116858 | A1 | 7/2001 |
| EP | 1190791 | A2 | 3/2002 |
| EP | 1958688 | A1 | 8/2008 |
| EP | 2032243 | B1 | 1/2014 |
| GB | 1349385 | A | 4/1974 |
| GB | 2048927 | A | 12/1980 |
| GB | 2190412 | A | 11/1987 |
| GB | 2204625 | A | 11/1988 |
| GB | 2261894 | A | 6/1993 |
| GB | 2268768 | A | 1/1994 |
| GB | 2270492 | A | 3/1994 |
| GB | 2270493 | A | 3/1994 |
| GB | 2323398 | A | 9/1998 |
| GB | 2345710 | A | 7/2000 |
| GB | 2351747 | A | 1/2001 |
| GB | 2367081 | A | 3/2002 |
| GB | 2408735 | A | 6/2005 |
| GB | 2413575 | A | 11/2005 |
| GB | 2413813 | A | 11/2005 |
| GB | 2418215 | A | 3/2006 |
| GB | 2422623 | A | 8/2006 |
| GB | 2427215 | A | 12/2006 |
| GB | 2429471 | A | 2/2007 |
| GB | 2429717 | B | 3/2007 |
| GB | 2429727 | A | 3/2007 |
| GB | 2438073 | A | 11/2007 |
| GB | 2447776 | A | 9/2008 |
| GB | 2455425 | A | 6/2009 |
| JP | S59219500 | | 12/1984 |
| JP | S60187603 | A | 9/1985 |
| WO | 9323204 | A1 | 11/1993 |
| WO | 9846344 | A1 | 10/1998 |
| WO | 0028106 | A1 | 5/2000 |
| WO | 0198978 | A1 | 12/2001 |
| WO | 2003091586 | | 6/2003 |
| WO | 2004040095 | A1 | 5/2004 |
| WO | 2004106003 | A1 | 12/2004 |
| WO | 2004106004 | A1 | 12/2004 |
| WO | 2007042920 | A1 | 4/2007 |
| WO | 2008063568 | A1 | 5/2008 |
| WO | 2009051022 | A2 | 4/2009 |
| WO | 2010098978 | A1 | 9/2010 |
| WO | 2010148313 | A2 | 12/2010 |

OTHER PUBLICATIONS

Office Action issued in Canadian Patent Application No. 2588331 dated Jan. 8, 2014, 2 pages.
Office Action issued in Canadian Patent Application No. 2588331 dated Apr. 19, 2013, 3 pages.
Office Action issued in Canadian Patent Application No. 2619526 dated Sep. 30, 2009, 3 pages.
Office Action issued in Canadian Patent Application No. 2619526 dated Apr. 29, 2011, 2 pages.
Voluntary Amendment in Canadian Patent Application No. 2619526 dated Apr. 29, 2011, 2 pages.
Examination Report issued in Canadian Patent Application No. 2619547 dated Oct. 20, 2014, 2 pages.
Examination Report issued in Canadian Patent Application No. 2619547 dated Jan. 29, 2014, 4 pages.
Office Action issued in Chinese Patent Application No. 200980127904.8 dated Feb. 5, 2013, 15 pages.
Office Action issued in Chinese Patent Application No. 200980127904.8 dated Oct. 31, 2013, 7 pages.
Office Action issued in Chinese Patent Application No. 200980127904.8 dated Dec. 10, 2014, 7 pages.
Office Action issued in Chinese Patent Application No. 200980127904.8 dated Aug. 1, 2014, 8 pages.
First Office Action issued in Chinese Patent Application No. 201080036092.9 dated Nov. 29, 2013, 8 pages.
Office Action issued in European Patent Application No. 08101339.3 dated Feb. 7, 2013, 7 pages.
Office Action issued in European Patent Application No. 08101339.3 dated Jan. 15, 2009, 1 page.
Examination Report issued in GB Patent Application No. 0708915.4 dated Jun. 30, 2010, 1 page.
Examination Report issued in GB Patent Application No. 0708915.4 dated Dec. 6, 2010, 5 pages.
Search Report issued in GB Patent Application No. 0708915.4 dated Aug. 16, 2007, 1 page.
Combined Search and Examination Report issued in GB Patent Application No. 0802233.7 dated May 19, 2008, 2 pages.
Examination Report issued in GB Patent Application No. 0805168.2 dated May 4, 2012, 3 pages.
Examination Report issued in GB Patent Application No. 0805168.2 dated Aug. 9, 2011, 2 pages.
Examination Report issued in GB Patent Application No. 0805168.2 dated Jul. 17, 2008, 2 pages.
Extended European Search Report issued in European Patent Application No. 08101339.3 dated Jul. 1, 2008, 8 pages.
Examination Report issued in GB Patent Application No. 0820881.1 dated Jun. 18, 2012, 2 pages.
Examination Report issued in GB Patent Application No. 0820881.1 dated Aug. 23, 2011, 4 pages.
Examination Report issued in GB Patent Application No. 0820881.1 dated Dec. 13, 2011, 4 pages.
Search Report issued in GB Patent Application No. 0820881.1 dated Jan. 5, 2009, 2 pages.
Combined Search and Examination Report issued in GB Patent Application No. 0916520.0 dated Oct. 23, 2009, 2 pages.
Final Office Action issued in U.S. Appl. No. 11/689,434 dated Jan. 19, 2010, 8 pages.
Combined Search and Examination Report issued in GB Patent Application No. 1010841.3 dated Jul. 15, 2010, 2 pages.
Examination Report issued in related GB Patent Application No. 1101214.3 dated Jan. 27, 2012, 3 pages.
Examination Report issued in GB Patent Application No. 1206076.0 dated Jul. 19, 2012, 3 pages.
Examination Report issued in GB Patent Application No. 1206076.0 dated Jun. 26, 2012, 1 page.
Combined Search and Examination Report issued in GB Patent Application No. 1206076.0 dated May 4, 2012, 4 pages.
Combined Search and Examination Report issued in GB Patent Application No. 1210470.9 dated Jun. 29, 2012, 5 pages.
International Search Report issued in International Patent Application No. PCT/US2009/051022 dated Feb. 24, 2010, 7 pages.
International Preliminary Report on Patentability issued in International Patent Application No. PCT/US2009/051022 dated Jan. 18, 2011, 5 pages.
International Search Report issued in International Patent Application No. PCT/US2009/051047 dated Feb. 24, 2010, 3 pages.
Written Opinion issued in International Patent Application No. PCT/US2009/051047 dated Feb. 24, 2010, 5 pages.
International Preliminary Report on Patentability issued in International Patent Application No. PCT/US2009/051047 dated Jan. 18, 2011, 6 pages.
International Search Report issued in International Patent Application No. PCT/US2010/033936 dated Jan. 14, 2011, 4 pages.
Written Opinion issued in International Patent Application No. PCT/US2010/033936 dated Jan. 14, 2011, 5 pages.
International Preliminary Report on Patentability issued in International Patent Application No. PCT/US2010/033936 dated Nov. 9, 2011, 6 pages.

(56) References Cited

OTHER PUBLICATIONS

International Search Report and Written Opinion issued in International Patent Application No. PCT/US2010/039184 dated Jan. 26, 2011, 6 pages.
International Preliminary Report on Patentability issued in International Patent Application No. PCT/US2010/039184 dated Dec. 20, 2011, 4 pages.
Office Action issued in U.S. Appl. No. 11/689,434 dated Jun. 5, 2009, 9 pages.
Office Action issued in U.S. Appl. No. 11/689,434 dated Jul. 20, 2010, 15 pages.
Notice of Allowance issued in U.S. Appl. No. 11/689,434 dated Jan. 6, 2011, 9 pages.
Translation of Japanese Unexamined Patent Application No. S59-218500, "Diamond Sintering and Processing Method," Shuji Yatsu and Tetsuo Nakai, inventors; application published Dec. 10, 1984, Applicant: Sumitomo Electric Industries, Co. Ltd, 10 pages.
Office Action issued in U.S. Appl. No. 11/745,726 dated Sep. 1, 2010, 13 pages.
Office Action issued in U.S. Appl. No. 11/745,726 dated Mar. 12, 2010, 16 pages.
Radke et al., Faster Drilling, Longer Life: Thermally Stable Diamond Drill Bit Cutters, 2004 GasTIPS, 5 pages.
Office Action issued in U.S. Appl. No. 14/301,906 dated Mar. 17, 2017, 16 pages.
Office Action issued in related U.S. Appl. No. 12/026,525 dated Sep. 17, 2010, 10 pages.
Office Action issued in U.S. Appl. No. 12/399,369 dated Apr. 25, 2012, 16 pages.
Office Action issued in U.S. Appl. No. 12/399,369 dated Oct. 19, 2012, 15 pages.
Office Action issued in U.S. Appl. No. 12/399,369 dated Mar. 10, 2015, 9 pages.
Office Action issued in U.S. Appl. No. 12/399,369 dated Aug. 18, 2012, 10 pages.
Office Action issued in U.S. Appl. No. 12/399,369 dated Apr. 13, 2016, 9 pages.
Office Action issued in U.S. Appl. No. 12/399,369 dated Jan. 26, 2017, 9 pages.
Office Action issued in U.S. Appl. No. 12/505,297 dated Mar. 8, 2012, 11 pages.
Office Action issued in U.S. Appl. No. 12/505,297 dated Aug. 17, 2012, 8 pages.
Office Action issued in U.S. Appl. No. 12/505,297 dated Feb. 18, 2015, 17 pages.
Office Action issued in U.S. Appl. No. 12/505,297 dated Sep. 16, 2015, 19 pages.
Office Action issued in U.S. Appl. No. 12/505,297 dated Jul. 15, 2016, 22 pages.
Office Action issued in U.S. Appl. No. 12/505,316 dated Feb. 16, 2010, 16 pages.
Third-Party Submission under 37 C.F.R. 1.99 in U.S. Appl. No. 12/505,316 dated Feb. 17, 2010, 9 pages.
Third-Party Submission under 37 C.F.R. 1.99 in U.S. Appl. No. 12/505,316 dated Jan. 21, 2010, 3 pages.
Third-Party Submission under 37 C.F.R. 1.99 in U.S. Appl. No. 12/505,316 dated Feb. 8, 2010, 165 pages.
Office Action issued in U.S. Appl. No. 12/505,316 dated Dec. 27, 2010, 27 pages.
Office Action issued in U.S. Appl. No. 12/775,420 dated May 9, 2012, 38 pages.
Office Action issued in U.S. Appl. No. 12/775,420 dated Jan. 15, 2013, 50 pages.
Office Action issued in U.S. Appl. No. 12/775,420 dated May 1, 2013, 40 pages.
Office Action issued in U.S. Appl. No. 12/775,420 dated Dec. 6, 2013, 18 pages.
Office Action issued in U.S. Appl. No. 12/818,780 dated Nov. 1, 2012, 9 pages.
Office Action issued in U.S. Appl. No. 12/818,780 dated Mar. 28, 2013, 11 pages.
Office Action issued in U.S. Appl. No. 12/818,780 dated Oct. 31, 2013, 11 pages.
Office Action issued in U.S. Appl. No. 13/155,043 dated Oct. 2, 2012, 20 pages.
Office Action issued in U.S. Appl. No. 13/671,019 dated Feb 5, 2016, 8 pages.
Office Action issued in U.S. Appl. No. 13/925,320 dated Nov. 20, 2014, 9 pages.
Office Action issued in U.S. Appl. No. 13/925,320 dated May 20, 2015, 25 pages.
Office Action issued in U.S. Appl. No. 11/958,314 dated Feb. 4, 2015, 17 pages.
Office Action issued in U.S. Appl. No. 11/958,314 dated Dec. 2, 2013, 19 pages.
Office Action issued in U.S. Appl. No. 11/958,314 dated Mar. 2, 2010, 11 pages.
Office Action issued in U.S. Appl. No. 11/958,314 dated Aug. 18, 2010, 9 pages.
Office Action issued in U.S. Appl. No. 11/958,314 dated Apr. 25, 2011, 10 pages.
Office Action issued in U.S. Appl. No. 11/958,314 dated Jun. 17, 2013, 9 pages.
Non-final Office Action issued in U.S. Appl. No. 12/399,369, dated Nov. 17, 2017, 7 pages.
Examination Report for GB Patent Application No. 0805168.2, dated Jan. 27, 2012, 2 pages.
Search Report issued in GB Patent Application No. 0805168.2, dated Jul. 17, 2008, 4 pages.
Office Action issued in U.S. Appl. No. 12/026,398, dated Mar. 13, 2009, 9 pages.
Office Action issued in U.S. Appl. No. 12/026,398, dated Nov. 20, 2009, 12 pages.
Dr. Shin-Ichiro Takasu, Influence of Solvent Types on the Characteristics of Synthetic Diamonds, Toshiba Central Research Laboratory, Kawasaki, JP, as published in Science and Technology of Industrial Diamonds, vol. II, edited by John Burls, 1966.

POLYCRYSTALLINE DIAMOND CONSTRUCTION WITH CONTROLLED GRADIENT METAL CONTENT

CROSS REFERENCE TO RELATED APPLICATIONS

This application is a divisional patent application of U.S. patent application Ser. No. 11/958,314, filed Dec. 17, 2007, which is incorporated by reference.

BACKGROUND OF THE INVENTION

Polycrystalline diamond (PCD) materials known in the art are made by subjecting a volume of diamond grains to high pressure/high temperature (HPHT) conditions in the presence of a catalyst material, such as a solvent catalyst metal. Such PCD materials are known for having a high degree of wear resistance, making them a popular material choice for use in such industrial applications as cutting tools for machining, and wear and cutting elements that are used in subterranean mining and drilling, where such high degree of wear resistance is desired. In such applications, conventional PCD materials can be provided in the form of a surface layer or a material body of, e.g., a cutting element used with cutting and drilling tools, to impart desired levels of wear resistance thereto.

Traditionally, PCD cutting elements used in such applications comprise a PCD body that is attached to a suitable substrate. Substrates used in such cutting element applications include carbides such as cemented tungsten carbide (WC-Co) that operate to facilitate attachment of the PCD cutting element to an end use device, such as a drill bit, by welding or brazing process.

Such conventional PCD comprises about 10 percent by volume of a catalyst material to facilitate intercrystalline bonding between the diamond grains, and to bond the PCD material to the underlying substrate. Catalyst materials that are conventionally used for this purpose include solvent catalyst metals, such as those selected from Group VIII of the Periodic table including cobalt, iron, nickel, and mixtures thereof.

The amount of catalyst material used to form PCD materials represents a compromise between desired properties of thermal stability, toughness, strength, hardness, and wear resistance. A higher metal catalyst content typically produces a PCD material having increased toughness, but decreased thermal stability (due both to the catalytic and expansion properties of the metal catalyst at elevated operating temperatures), and decreased hardness and wear resistance. Thus, such resulting PCD material may not be well suited for use in applications calling for a high degree of thermal stability, hardness or wear resistance, but may be well suited for applications calling for a high degree of toughness.

Conversely, a lower metal catalyst content typically produces a PCD material having increased properties of thermal stability, hardness and wear resistance, but reduced toughness. Thus, such resulting PCD material may not be well suited for use in applications calling for a high degree of toughness, but may be well suited for applications calling for a high degree of thermal stability, hardness or wear resistance.

Accordingly, the amount of the catalyst or metal material that is used to make PCD materials represents a compromise that is dependent on the desired properties of the PCD material for a particular end-use application. In addition to the properties of the PCD material, when the PCD construction is provided in the form of a PCD cutting element or compact comprising a substrate, the amount of the metal component in the substrate may also impact both the composition of the PCD body and the performance properties of the substrate. For example, when the substrate is used as the source of the catalyst or metal material during the process of making the PCD body by HPHT process, the content of the catalyst material within the substrate can and will impact the amount of catalyst material that infiltrates into the diamond grain volume and that resides in the resulting PCD material.

Additionally, the amount of the catalyst or metal material in the substrate can impact the performance of the cutting element during operation. For example, when the cutting element is used in a subterranean drilling operation with a drill bit, substrates having a high metal content can erode during use, which can reduce the effective service life of the cutting element.

It is, therefore, desired that a PCD construction be developed in a manner that provides a desired level of thermal stability, toughness, strength, hardness, and wear resistance making the construction useful as a cutting element for applications calling for the same such as subterranean drilling to thereby provide an improved service live when compared to conventional PCD materials. It is further desired that such PCD construction be developed in a matter that reduces unwanted erosion of the substrate when placed into use applications, such as subterranean drilling, where the construction is exposed to an erosive operating environment.

SUMMARY OF THE INVENTION

Polycrystalline diamond constructions, constructed according to principles of the invention, are specially engineered having a controlled metal content to provide a desired combination of thermal stability, toughness, strength, hardness, and wear resistance properties useful for certain wear and/or cutting end-use applications. Such constructions generally comprise a diamond body attached or joined to a metallic substrate. The diamond body comprises a plurality of bonded together diamond crystals, interstitial regions disposed between the crystals, and one or more metal materials disposed within the interstitial regions. The one or more metal materials comprises a catalyst material used to form the diamond body at high pressure/high temperature conditions, e.g., greater than about 6,000 MPa, and is selected from Group VIII of the Periodic table.

The diamond body includes one or more working surfaces, and has a metal content that changes, e.g., increases, moving away from the working surface. The working surface can extend along a peripheral edge of the body. In an example embodiment, the change in metal content occurs in a gradient manner, and may or may not change as a function of radial position within the diamond body. The metal content in the diamond body working surface is in the range of from about 2 to 8 percent by weight, and the metal content in other regions of the diamond body is between about 10 to 20 percent by weight.

The diamond body includes a metal rich zone adjacent the substrate, and the substrate includes a metal depleted zone adjacent the diamond body. The metal content within at least one region of the metal rich zone is greater than the metal content in the remaining region of the diamond body. In an example embodiment, the metal content at a point in the diamond body adjacent the metal rich zone is at least about 3 percent by weight greater, and can be at least about 6 percent by weight greater, than the metal content at a point in the metal depleted zone, that includes at the interface. The point in the diamond body adjacent the metal rich zone is positioned at least about 100 microns from the interface.

In an example embodiment, the metal content within the metal depleted zone increases in a gradual manner moving axially away from the diamond body. The thickness of the metal depleted zone can be greater than about 1.25 mm, and in some embodiments greater than about 2 mm. The metal content within the metal depleted zone can change less than about 4 percent by weight per millimeter moving axially along the substrate.

Polycrystalline diamond constructions of this invention display desired elevated properties of thermal stability, hardness and wear resistance at the working surface, e.g., where needed most for a particular end-use application, with acceptable levels of toughness and strength, while the remaining regions have relatively enhanced levels of strength and toughness, with acceptable levels of thermal stability, hardness and wear resistance, e.g., at locations that are not the working surface. In particular, such constructions display reduced residual stress from improved thermal matching between the diamond body and substrate resulting from the controlled metal content, thereby reducing the unwanted occurrence of crack formation within the body and/or substrate that can lead to premature part failure.

BRIEF DESCRIPTION OF THE DRAWINGS

These and other features and advantages of the present invention will become appreciated as the same becomes better understood with reference to the specification, claims and drawings wherein:

DETAILED DESCRIPTION

As used in this specification, the term polycrystalline diamond, along with its abbreviation "PCD," is used herein to refer to the material produced by subjecting a volume of individual diamond crystals or grains and a catalyst material to sufficiently high pressure and high temperature (HPHT) conditions that causes intercrystalline bonding to occur between adjacent diamond crystals to form a network of diamond crystal-to-diamond crystal bonding.

PCD constructions of this invention have been specially engineered to have a controlled metal content to provide combined optimized performance properties of thermal stability, toughness, strength, hardness, and wear resistance. Specifically, in such constructions, the PCD body is provided having a reduced or low metal content near a working surface, with a metal content that changes within the body, e.g., increases, with increasing distance moving away from the working surface. The change in metal content within the PCD body can occur in a gradient or a stepped fashion.

To further improve the performance properties and service life of PCD constructions of this invention, such PCD constructions are engineered having a controlled change in metal content within a transition region of the construction moving from the PCD body to a substrate that is joined to the PCD body at HPHT conditions. Generally, the transition region includes a metal content rich zone in the PCD body adjacent the substrate interface, and a metal content depleted zone in the substrate adjacent the PCD body interface. PCD constructions of this invention comprise controlled metal content levels in the PCD body, the metal content rich zone, and in the metal depleted zone that operate to reduce the mismatch in the thermal expansion properties between the PCD body and the substrate, thereby reducing residual stresses within the construction to improve the operating service life of the construction.

Configured in this manner, PCD constructions of this invention are engineered to provide improved combined properties of thermal stability, toughness, strength, hardness, and wear resistance when compared to conventional PCD constructions formed at HPHT conditions.

Figure 1:
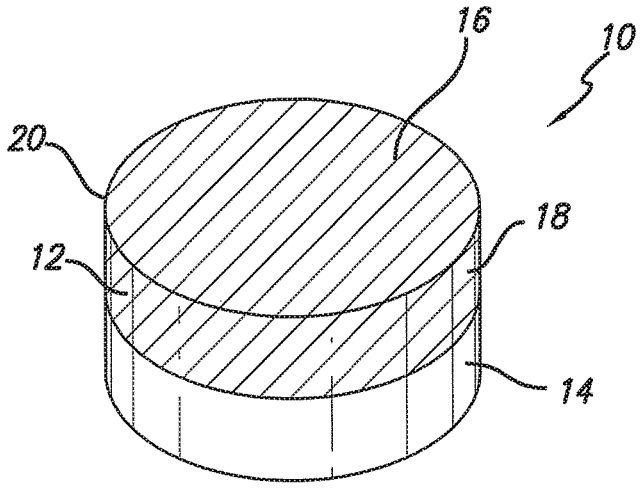
FIG. 1 is a perspective side view of an example PCD construction of the invention.

FIG. 1 illustrates an example PCD construction 10 of this invention comprising a PCD body 12 that is attached to a suitable substrate 14. While a particular configuration of the PCD body and substrate has been illustrated, e.g., one having a generally cylindrical configuration, it is to be understood that PCD constructions of this invention can have other geometries as called for by the particular end-use application, which are within the scope of this invention. The PCD body 12 includes a working surface that can include all or a portion of a top surface 16 and/or a side surface 18 of the body. Further, the working surface can include an edge surface 20, interposed between the top and side surfaces that may or may not be beveled depending on the particular end-use application.

The PCD body 12 is formed by subjecting a volume of diamond grains to HPHT conditions in the presence of a suitable catalyst material. In an example embodiment, the catalyst material is a solvent catalyst metal selected from Group VIII of the Periodic table. The catalyst material can be provided in powder form mixed together with the diamond grains prior to sintering, or can be provided by infiltration into the diamond grain volume during HPHT processing from an adjacent material, such as a substrate material that includes as a constituent the catalyst material.

In the event that the source of the catalyst material is the substrate, such substrate can be removed after HPHT processing or can remain attached to the PCD body thereby forming the final PCD construction. For example, it may be desired to remove the substrate after HPHT processing for purposes of providing a different substrate having different material properties for forming the final PCD construction. For example, it may be desired that the substrate used for catalyst material infiltration during HPHT processing have one level of catalyst material content and/or comprise one type of catalyst material, and that the substrate material for the final PCD construction have a metal content and/or comprise a type of metal that is different from the infiltration substrate.

The diamond grains used to form the PCD body can be synthetic or natural. In certain applications, such as those calling for an improved degree of control over the amount of catalyst material or metal remaining in the PCD material, it may be desired to use natural diamond grains for their absence of catalyst material entrapped within the diamond crystals themselves. The size of the diamond grains used to make PCD materials of this invention can and will vary depending on the particular end use application, and can consist of a monomodal distribution of diamond grains having the same general average particle size, or can consist of a multimodal distribution (bi, tri, quad, penta or log-normal distribution) of different volumes of diamond grains of different average particle size. The diamond grains can be arranged such that different locations of the body are formed from diamond grains having a different grain size and/or a different grain size distribution.

In an example embodiment, the diamond grains can have an average diameter grain size in the range of from submicrometer in size to 100 micrometers, and more preferably in the range of from about 1 to 80 micrometers. The diamond powder can contain grains having a mono or multi-modal size distribution. In an example embodiment, the diamond powder has an average particle grain size of approximately 20 micrometers. In the event that diamond powders are used having differently sized grains, the diamond grains are mixed together by conventional process, such as by ball or attritor milling for as much time as necessary to ensure good uniform distribution. The diamond grain powder is preferably cleaned, to enhance the sinterability of the powder by treatment at high temperature, in a vacuum or reducing atmosphere. The diamond powder mixture is loaded into a desired container for placement within a suitable HPHT consolidation and sintering device.

Suitable substrates useful as a source for infiltrating the catalyst material into the diamond grain volume during HPHT processing can include those used to form conventional PCD materials, and can be provided in powder, green state, and/or already sintered forms. A feature of such substrate is that it includes a metal solvent catalyst that is capable of melting and infiltrating into the adjacent volume of diamond powder to facilitate bonding the diamond grains together during the HPHT process. Suitable substrate materials include those formed from metallic materials, ceramic materials, cermet materials, and mixtures thereof. In an example embodiment, the catalyst material is one or more Group VIII metal from the Periodic table such as Co, and a substrate useful for providing the same is a cobalt-containing substrate, such as WC-Co.

Alternatively, the diamond powder mixture can be provided in the form of a green-state part or mixture comprising diamond powder that is combined with a binding agent to provide a conformable material product, e.g., in the form of diamond tape or other formable/conformable diamond mixture product to facilitate the manufacturing process. In the event that the diamond powder is provided in the form of such a green-state part, it is desirable that a preheating step take place before HPHT consolidation and sintering to drive off the binder material.

The diamond powder mixture or green-state part is loaded into a desired container for placement within a suitable HPHT consolidation and sintering device. When a substrate is provided as the source of the catalyst material, the substrate is positioned adjacent the diamond powder mixture in the container for HPHT processing. The HPHT device is activated to subject the container to a desired HPHT condition to effect consolidation and sintering of the diamond powder. In an example embodiment, the device is controlled so that the container is subjected to a HPHT process having a pressure greater than about 5,000 MPa, and preferably of about 6,000 MPa or greater, and a temperature of from about 1,350° C. to 1,500° C. for a predetermined period of time. At this pressure and temperature, the catalyst material melts and infiltrates into the diamond powder mixture, thereby sintering the diamond grains to form PCD. After the HPHT process is completed, the container is removed from the HPHT device, and the so-formed PCD material is removed from the container. When a substrate is loaded into the container, the part resulting from the HPHT process is a construction comprising a PCD body that is integrally joined to the construction.

A feature of PCD constructions of this invention is that the metal content within the construction is intentionally controlled to provide desired thermal and physical properties therein. In an example embodiment, the metal content within the PCD body is not constant but rather changes moving away from a working surface of the PCD body. In an example embodiment, the metal content within the body can change in a gradient or a stepped fashion. The change can occur in any direction within the body moving away from the working surface. For example, when the working surface of the PCD body is positioned along a peripheral edge of the body, the metal content can change moving radially inwardly away from the edge and/or moving axially away from the edge. The particular manner in which the metal content within the PCD body changes can and will vary depending on the particular end-use application. Generally, when the PCD body is to be used in a wear and/or cutting application, it is desired that the metal content within the body increases moving away from the working surface.

In an example embodiment, the PCD body comprises less than about 8 percent by weight, and preferably less than about 6 percent by weight, metal content at the working surface. In an example embodiment, the PCD body comprises less than about 4 percent by weight, and preferably greater than about 2 percent by weight, metal content at the working surface. Thus, the metal content at the PCD body working surface can be in the range of from about 2 to 8 percent by weight. The working surface of the PCD body includes those surface or surface sections noted above, e.g., that can include all or a portion of the top, edge, and/or side surfaces.

Figure 2:
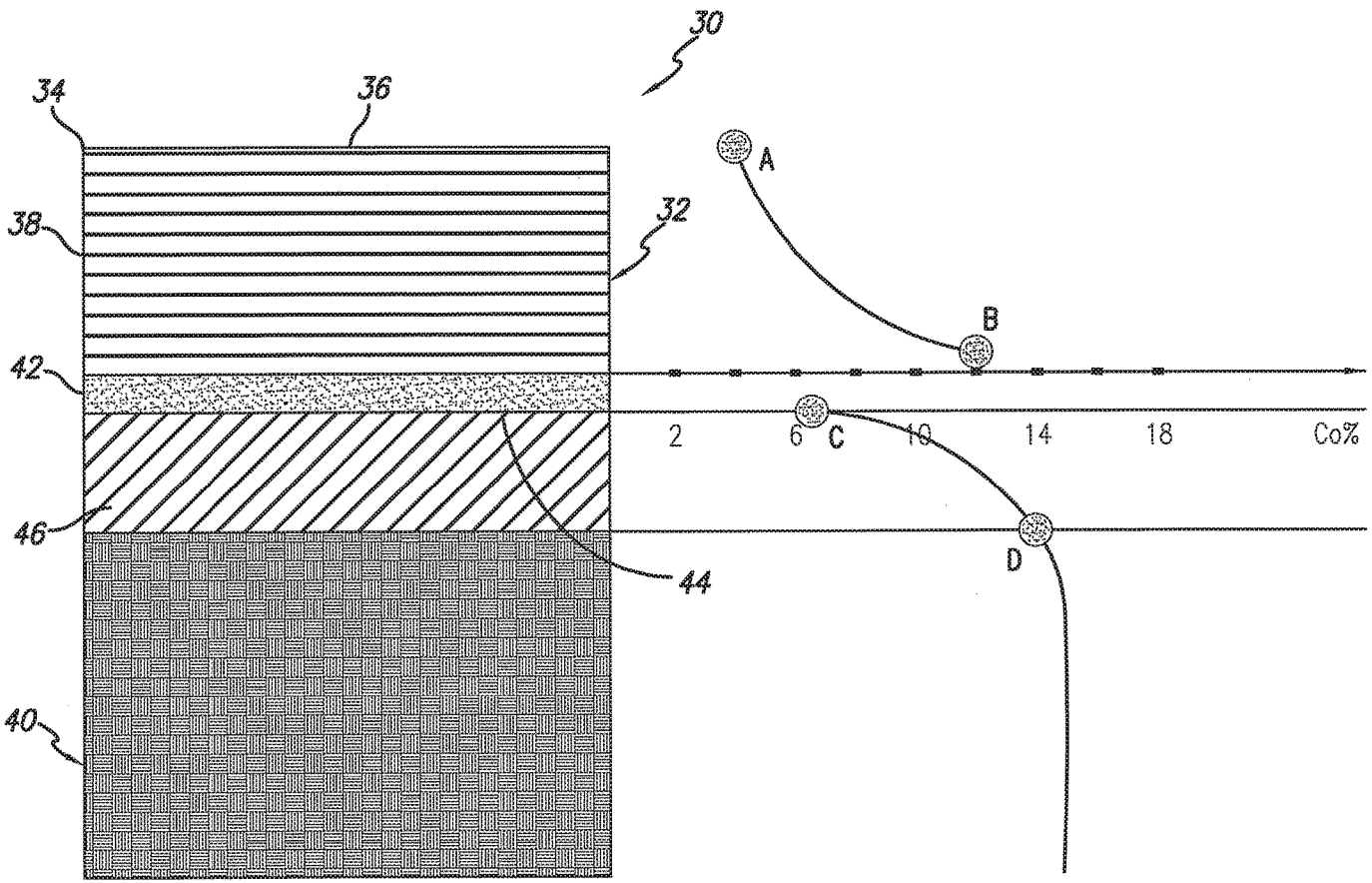
FIG. 2 is a cross-sectional side view of the example PCD construction of FIG. 1 illustrating the approximate metal content as a function of position within the construction.

FIG. 2 illustrates an example embodiment PCD construction 30 of the invention, and further illustrates the nature of the changes in metal content within the construction as a function of position within the construction. In this particular embodiment, the PCD construction includes a PCD body 32 comprising a working surface positioned along a peripheral edge 34 of the body interposed between the body top and side surfaces 36 and 38.

As illustrated, the metal content in the PCD body 32 is the least along the working surface or edge 34, between about 2 to 8 percent by weight, more preferably between about 2 to 4 percent by weight, and increases in a gradient manner moving axially away from the working surface or edge in this particular embodiment. In this example embodiment, the metal content in the PCD body 32 increases in a gradient manner from about 4 percent by weight at the working surface to about 12 percent by weight along a portion of the PCD body adjacent a substrate 40 moving axially along the side surface 38 of the body. However, the maximum metal content within the PCD body can be 20 percent by weight or less. The PCD body metal content illustrated in FIG. 2 can be representative of an average metal content for the entire radial cross section of the body, or can be representative of the metal content for only a portion of the radial cross section of the body, e.g., a portion extending radially inwardly a partial depth from the sidewall surface.

In an example embodiment, the metal content within the PCD body can be constant or change moving radially inwardly along the body away from the edge 34. For example, the metal content can increase moving radially inwardly along the top surface 36 away from the edge 34 to some maximum amount near a mid-point of the body. Such changing metal content is understood to represent an average metal content taken along the top surface 36 of the PCD body for a fixed depth beneath the top surface 36. For example, the metal content along this upper region can be for a depth of about 1 mm from the top surface 36. It is to be understood that the depth considered for purposes of measuring the metal content within the PCD body can and will vary depending on the particular PCD body construction and end-use application.

Again, it is desired that the maximum metal content within the PCD body be 20 percent by weight or less. As illustrated in FIG. 2, the metal content in this particular embodiment increases in a gradient manner moving axially along the PCD body to a maximum amount of about 12 percent by weight at a point, point "B" in FIG. 2, adjacent a metal rich region or zone 42. In an example embodiment, point "B" within the PCD body is positioned at least about 100 microns from a substrate interface 44. The metal rich zone 42 is positioned within the PCD body along a region adjacent the substrate an interface 44. In an example embodiment, the metal rich zone 42 is a relatively thin layer or region within the PCD body that includes a metal content higher than that in the remaining regions of the PCD body.

The PCD body comprising such desired metal content distribution can be achieved by different methods. For example, the mixture used to form the PCD body can be formed from selected diamond grain sizes and/or grain size distribution that will impact the extent of catalyst material infiltration within the diamond body. For example, for the region of the PCD body calling for a low metal content, such region can be formed from diamond powders providing a dense packing that produces a lower volume of interstitial regions and, thus a reduced metal content therein, while the diamond powders used to form the remaining portion of the PCD body can be configured having a gradually decreased degree of packing, thereby producing a gradually increasing volume of interstitial regions and resulting metal content therein.

Alternatively, or in addition to the above mentioned technique, different types of additives can be used to achieve the desired metal content distribution. For example, additives can be combined with the diamond powder to reduce the volume of interstitial regions or the extent of infiltration in a particular region calling for a reduced metal content, and the amount of such additive that is combined with the diamond powder can be gradually reduced moving away from the region calling for the reduced metal content. Examples of such additives effective for reducing the metal content within the PCD body include materials such as Si, WC, VC, or other metals or alloys which are different from the infiltrated catalyst material. The additives are less active chemically, and ideally, have lower coefficient of thermal expansion than the infiltrated material.

Conversely, additives can be combined with the diamond powder to increase the volume of interstitial regions or the extent of infiltration in a particular region calling for increased metal content, and the amount of such additive that is combined with the diamond powder can be gradually increased moving away from a desired region calling for a reduced metal content. Examples of such additives useful for this purpose can be the same as those described above. Such additives can have be specifically shaped and/or sized to control the space to be filled by the infiltrated catalyst material.

PCD bodies having a gradient metal content can also be obtained by reinfiltration, wherein a PCD body is first provided by conventional HPHT sintering, and is then leached to obtain a PCD body substantially free of the catalyst material. The leached PCD body is then reinfiltrated with a desired metal to bond to the substrate and form the final PCD body having a desired metal content gradient. With this approach, the distribution of empty pores within the leached PCD body will affect the final metal content gradient. The diamond powder can be combined with one or more additives such as WC and the like positioned within the diamond volume to help form the desired gradient by creating a desired pore population and/or size at different locations within the resulting PCD body.

Further, the HPHT profile and/or cell design may also be engineered to affect the metal content distribution within the PCD body. In an example embodiment, it may be desired to combine one or more of the above-mentioned techniques to achieve optimum results. It is to be understood that the above-noted techniques are representative of a number of different methods that can be used to achieve the desired metal content distribution within the PCD body running axially and/or radially through the body.

It is desired that PCD constructions of this invention have a controlled metal content within the transition regions or zones of the construction moving from the PCD body 38 to the substrate 40. As illustrated in FIG. 2, the PCD body includes the metal rich zone 42 that is positioned adjacent the substrate interface 44 and that has a relatively thin thickness that extends into the PCD body from the substrate interface 44 at point "C". As noted above, in an example embodiment, the metal content within at least a region of this zone is greater than that in the remaining regions of the PCD body.

The metal content at point "B" within the PCD body, positioned adjacent to the metal rich zone 42 is engineered to be relatively higher than some or all the other regions of the PCD body positioned closer to the working surface. In an example embodiment, the metal content in the PCD body at point "B" is from about 10 to 20 percent by weight, and preferably of from about 12 to 16 percent by weight. A PCD body having a metal content at point "B" that is less than about 10 percent by weight may result in the formation of an undesired thermal residual stress between the PCD body and the substrate, making the resulting construction unsuited for certain end-use applications. The PCD body is essentially a composite formation comprising diamond grains and metal between the grains. The coefficient of thermal expansion (CTE) of the composite is affected by the weight percentage of metal contained therein. An increased metal content can increase the CTE of the PCD body and, thus bring the CTE of the PCD body closer to that of the substrate, which normally has a higher CTE than that of the PDF body. A PCD body having a metal content at point "B" that is greater than about 20 percent by weight may produce a construction having a reduced level of strength and hardness, making is unsuited for end-use applications calling for high levels of such properties.

In an example embodiment, the PCD body metal rich zone 42 has a thickness, that can and will vary depending on such factors as the size and amount of diamond grains used to form the PCD body, the HPHT process conditions used to form the PCD body, and/or the type of metal catalyst material used to form the same. In an example embodiment, the PCD body metal rich zone 42 has an average thickness in the range of from about 5 to 100 microns, preferably in the range of from about 10 to 60 microns, and more preferably in the range of from about 10 to 30 microns. The metal rich zone has a much higher metal content, e.g., a metal content of 20 percent by weight or more, than the metal content in the PCD body and/or the substrate, and comprises a composite of diamond grains, the metal, and carbides. In an example embodiment, the metal rich zone has a concentrated metal content that is greater than the metal content in both the PCD body and the substrate. The exact metal content within the metal rich zone depends on a number of factors including the amount of the metal constituent in the substrate, the diamond grains size and packing in the PCD body, and the HPHT conditions used to form the PCD body.

The PCD construction 30 includes a metal depleted region or zone 46 that extends axially a depth from the interface 44 into the substrate 40, and that extends from point "C" to point "D" as illustrated in FIG. 2. The metal content within this region 46 is relatively lower than that of the metal content in some or all of the regions of the substrate due to the migration of the metal constituent within this region during HPHT processing, and infiltration of such metal constituent into the PCD body. In an example embodiment, the metal content within this metal depleted region or zone 46 increases in a gradual manner moving axially along the thickness of the zone 46 from the interface, i.e., moving from point "C" to point "D" in FIG. 2.

In an example embodiment, the metal content at point "C" is in the range of from about 4 to 10 percent by weight, and preferably within the range of from about 5 to 8 percent by weight. In the particular example illustrated in FIG. 2, the metal content at point "C" is approximately 6 percent by weight. A PCD construction 30 having a metal content at point "C" of the metal depleted zone 46 that is less than about 4 percent by weight may produce a construction that is brittle and not well suited for certain end-use applications. A PCD construction 30 having a metal content at point "C" of the metal depleted zone that is greater than about 10 percent by weight may produce a high CTE at the interface 44, producing an increased CTE mismatch between the PCD body and the substrate that may not be desired for certain end-use applications.

In an example embodiment, the metal content at point "D" is in the range of from about 10 to 16 percent by weight, and preferably within the range of from about 12 to 14 percent by weight. In the particular example illustrated in FIG. 2, the metal content at point "D" is approximately 14 percent by weight. A PCD construction 30 having a metal content at point "D" of the metal depleted zone 46 that is less than about 10 percent by weight may not be capable of supplying a sufficient amount of metal during infiltration to sinter the PDF body properly. A PCD construction 30 having a metal content at point "D" of the metal depleted zone that is greater than about 16 percent by weight may reduce the hardness of the substrate and may cause erosion problems, making the resulting construction poorly suited for certain end-use applications calling for such properties.

It is further desired that depleted zone 46 have a thickness, as measured between points "C" and "D" that is calculated to provide a desired gradual transition of the metal content therebetween. In an example embodiment, it is desired that the thickness of the depleted zone 46 be greater than about 1.25 mm, and more preferably be greater than about 2 mm. In an example embodiment, the maximum thickness is less than about 3 mm. A depleted zone 46 having a thickness of less than about 1.25 mm may not provide a desired gradual degree of change in metal content therein calculated to provide a desired degree of attachment strength between the PCD body and the substrate for certain wear and/or cutting end-use applications. In an example embodiment, such gradual change in metal content within the metal depleted zone 44 can be characterized as being less than about 4 percent by weight per millimeter moving axially along the substrate from points "C" to "D".

In addition to the above-described desired metal contents within the metal rich and metal depleted zones 42 and 46, it is also desired that the differences in the metal content between points "B" in the PCD body and point "C" at the substrate interface 44 be intentionally controlled. In an example embodiment, it is desired that the difference in metal content between these points be controlled so as to reduce the extent of the thermal mismatch in the thermal expansion characteristics of the PCD body and substrate, and thereby reduce residual stress at the PCD body and substrate interface resulting therefrom. In an example embodiment, it is desired that the metal content at point "B" in the PCD body be at least 3 percent by weight greater than the metal content at point "C", and preferably be about 6 percent by weight greater than the metal content at point "C". A PCD construction having a metal content difference of less than about 3 percent by weight between points "B" and "C" may not provide a desired reduction in thermal expansion properties mismatch between the PCD body and the substrate to produce a desired reduction in residual stress that will result in the PCD construction having a desired service life when placed into a wear and/or cutting end-use application.

For the particular PCD construction illustrated in FIG. 2, the metal content at point "B" is approximately 6 percent by weight greater than that at point "C". It is to be understood that the specific metal content difference between these points may vary depending on such factors as the particular type of metal catalyst disposed within the PCD body, and the type of material used to form the substrate. In this particular embodiment, the metal catalyst is Co and the substrate is formed from WC-Co.

Referring to FIG. 2, moving axially away from the metal depleted zone 44 and point "D" in the substrate, the metal content within remaining region of the substrate remains substantially constant. In this particular embodiment, the metal content in the remainder of the substrate is approximately 14 percent by weight.

It is to be understood that the above described metal contents within the PCD construction 30 as illustrated in FIG. 2 represents an average of the metal contents taken along radial cross sections at the different axial positions along the PCD construction.

PCD constructions, constructed according to the principles of the invention, do not display the uncontrolled changes in metal content along the PCD body/substrate interface known to exist in conventional PCD constructions that result in the formation of cracks within this region, which can reduce the effective service life of the PCD construction when placed into operation.

The desired transition in metal content within the transition region of the PCD construction, including the metal rich and metal depleted regions, can be achieved using the same techniques noted above for achieving the desired metal content in the PCD body. For example, the PCD body can comprise diamond powder having a particular grain size and/or distribution that is positioned adjacent the substrate interface to regulate or control the extent and/or timing of metal infiltration into the diamond powder volume that operates to provide the desired metal content within the metal rich zone and metal depleted zone. Alternatively and/or additionally, additives can be used within the PCD body adjacent the substrate interface to produce the same effect.

Further, the desired metal content changes within the transition region can be achieved by replacing an infiltrant substrate with different substrate that includes a metal component that was not used for initially sintering the PCD body at HPHT conditions. The replacement substrate can comprise a material having a metal content that is the same or different from the substrate initially used to sinter the PCD body and/or that comprises the same or different type of metal. A desired gradient can be initially built within the substrate before it is attached to the PCD.

If desired, the substrate and PCD body can be configured having planar interfacing surfaces, or can be configured having nonplanar interfacing surfaces. In certain applications, calling for a high level of bond strength in the PCD construction between the PCD body and the substrate, the use of a nonplanar interface may be desired to provide an increased surface area between the adjoining surfaces to enhance the extent of mechanical coupling and load carrying capacity therebetween. The nonplanar interface can be provided in the form of a single or multiple complementary surface features disposed along each adjacent PCD body and substrate interface surface. The use of a nonplanar interface can have an impact on the average metal content values as measured along a radial section of the construction at different axial positions along the construction. The PCD construction 30 embodiment illustrated in FIG. 2 is one having a planar interface surface 44 between the PCD body 38 and the substrate 40.

Figure 3:
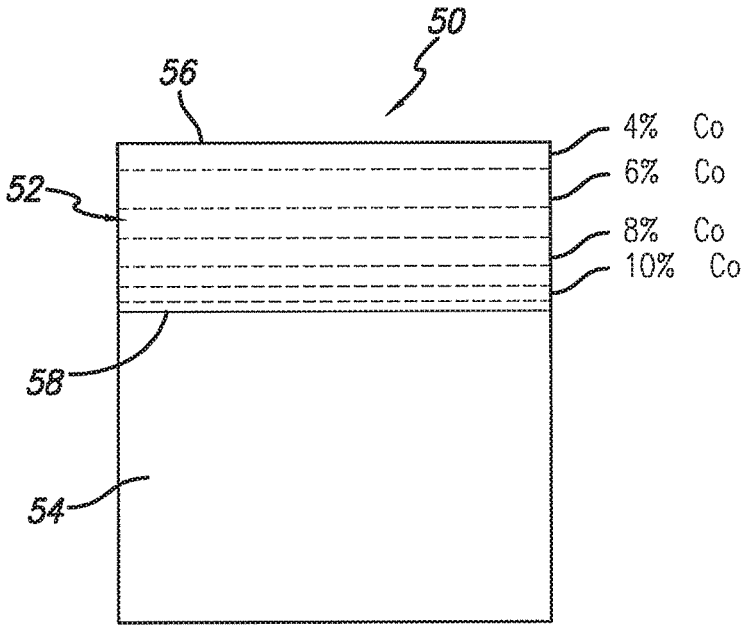
FIG. 3 is a cross-sectional side view of another example PCD construction of the invention.

FIG. 3 illustrates an example embodiment PCD construction 50 of this invention comprising a PCD body 52 that is attached to a substrate 54. The PCD body 52 of this example comprises a metal content that changes as a function of distance from a top surface 56, which may or may not be a construction working surface. FIG. 3 is useful for illustrating the changing metal content within the PCD body as a function of depth or distance from the top surface 56. In this particular embodiment, the metal content is constant at a particular depth and does not change as a function of radial position within the body. It is, however, understood that PCD constructions of this invention can have a metal content that does change, in a gradient or stepped manner, as a function of radial position within the body. In this example embodiment, the metal content at the top surface 56 is greater than about 2 percent by weight, and in this particular example is approximately 4 percent by weight. As illustrated, the metal content within the body changes, e.g., increases, as a function of distance from the surface 56 to a maximum amount of approximately 10 percent by weight that is adjacent an interface 58 with the substrate 54.

The metal content within the PCD body for this example can change in a gradient or stepped manner. In a preferred embodiment, the metal content changes in a gradient manner from about 4 percent by weight to about 10 percent by weight. The PCD construction 50 of this example provides a combination of desired thermal stability along the working surface with desired toughness at a lower region of the PCD body, and further comprises the desired controlled metal content within the metal rich and metal depleted zones within the PCD construction as described above.

PCD constructions of this invention are specially engineered having a desired metal content distribution to provide a desired combination of performance properties such as thermal stability, toughness, strength, hardness, and wear resistance. Specifically, PCD constructions of this invention comprise a reduced specific metal content along a working surface with a metal content that increases in a gradient or gradual manner in regions extending away from the working surface. Configured in this manner, the PCD construction has desired elevated properties of thermal stability, hardness and wear resistance at the working surface, e.g., where needed most for a particular end-use application, with acceptable levels of toughness and strength, while the remaining regions have relatively enhanced levels of strength and toughness, with acceptable levels of thermal stability, hardness and wear resistance, e.g., at locations that are not the working surface.

Further, PCD constructions of this invention are specially engineered having a desired controlled metal content moving from the PCD body, across the PCD body/substrate interface, and to the substrate, thereby minimizing and/or eliminating unwanted metal content variation within this interface region that can result in cracks developing within the PCD body and/or substrate that can lead to premature part failure.

PCD constructions as disclosed herein can be used for a number of different applications, such as for forming cutting and/or wear elements of tools used for mining, cutting, machining and construction applications, where the combined properties of thermal stability, wear and abrasion resistance, and strength, toughness and impact resistance are highly desired. Such PCD constructions are particularly well suited for forming working, wear and/or cutting surfaces on components used in machine tools and subterranean drill and mining bits such as roller cone rock bits, percussion or hammer bits, diamond bits, and shear cutters.

Figure 4:
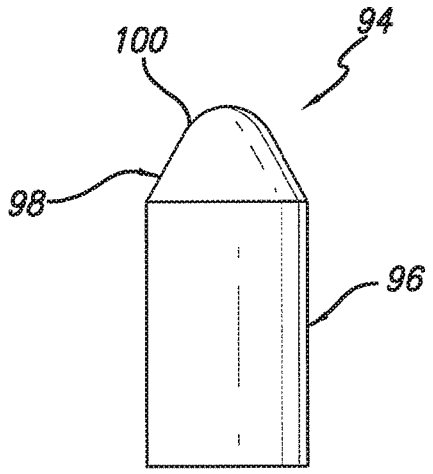
FIG. 4 is a perspective view of the PCD construction embodied in the form of a cutting insert.

FIG. 4 illustrates an embodiment of a PCD construction provided in the form of an insert 94 used in a wear or cutting application in a roller cone drill bit or percussion or hammer drill bit. For example, such PCD inserts 94 are constructed having a substrate 96, formed from one or more of the substrate materials disclosed above, that is attached to a PCD body 98, wherein the PCD body and substrate are constructed in the manner disclosed above having the controlled metal content. In this particular embodiment, the insert 94 comprises a domed working surface 100 formed from the PCD body 98. It is to be understood that PCD constructions can also be used to form inserts having geometries other than that specifically described above and illustrated in FIG. 4.

Figure 5:
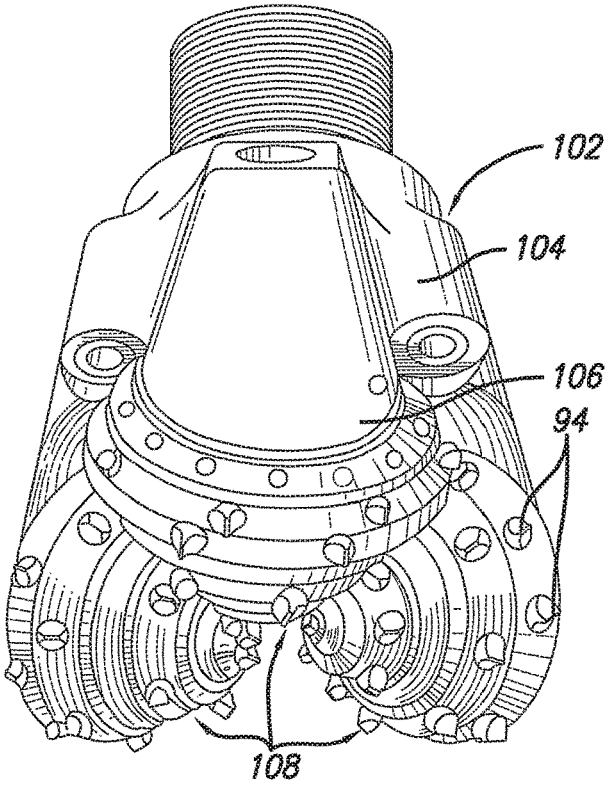
FIG. 5 is a perspective side view of a roller cone drill bit comprising a number of the cutting inserts of FIG. 4.

FIG. 5 illustrates a rotary or roller cone drill bit in the form of a rock bit 102 comprising a number of the wear or cutting PCD inserts 94 disclosed above and illustrated in FIG. 4. The rock bit 102 comprises a body 104 having three legs 106 extending therefrom, and a roller cutter cone 108 mounted on a lower end of each leg. The inserts 94 are the same as those described above comprising the PCD construction of this invention, and are provided in the surfaces of each cutter cone 108 for bearing on a rock formation being drilled.

Figure 6:
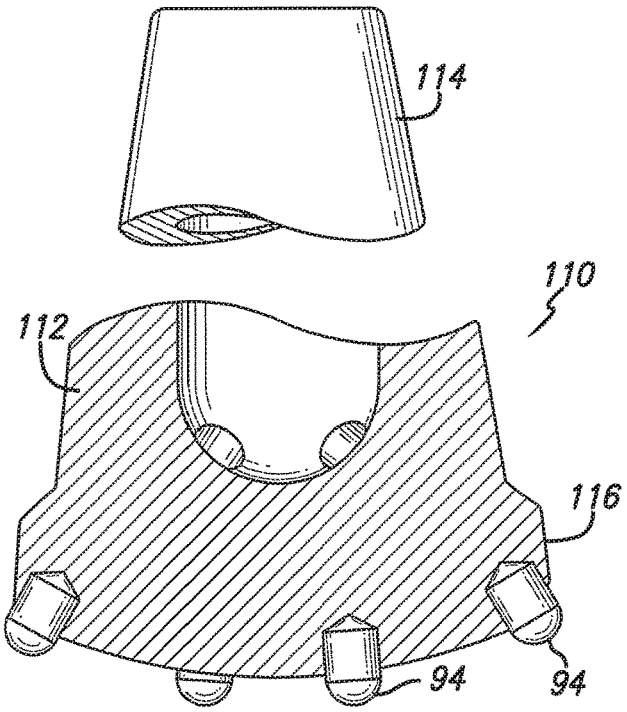
FIG. 6 is a perspective side view of a percussion or hammer bit comprising a number of the cutting inserts of FIG. 4.

FIG. 6 illustrates the PCD insert 94 described above and illustrated in FIG. 4 as used with a percussion or hammer bit 110. The hammer bit generally comprises a hollow steel body 112 having a threaded pin 114 on an end of the body for assembling the bit onto a drill string (not shown) for drilling oil wells and the like. A plurality of the inserts 94 are provided in the surface of a head 116 of the body 112 for bearing on the subterranean formation being drilled.

Figure 7:
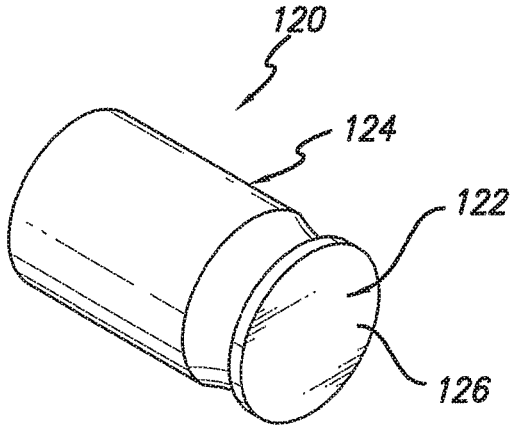
FIG. 7 is a perspective view of the PCD construction embodied in the form of a shear cutter.

FIG. 7 illustrates a PCD construction of this invention as used to form a shear cutter 120 used, for example, with a drag bit for drilling subterranean formations. The PCD shear cutter 120 comprises a PCD body 122 that is sintered or otherwise attached to a cutter substrate 124 as described above. The PCD body 122 includes a working or cutting surface 126. As discussed and illustrated above, the working or cutting surface for the shear cutter can extend from the upper surface to a beveled surface defining a circumferential edge of the upper surface. Additionally, if desired, the working surface can extend a distance axially along a portion of or the entire side surface of the shear cutter extending to the substrate 124. It is to be understood that PCD constructions can be used to form shear cutters having geometries other than that specifically described above and illustrated in FIG. 7.

Figure 8:
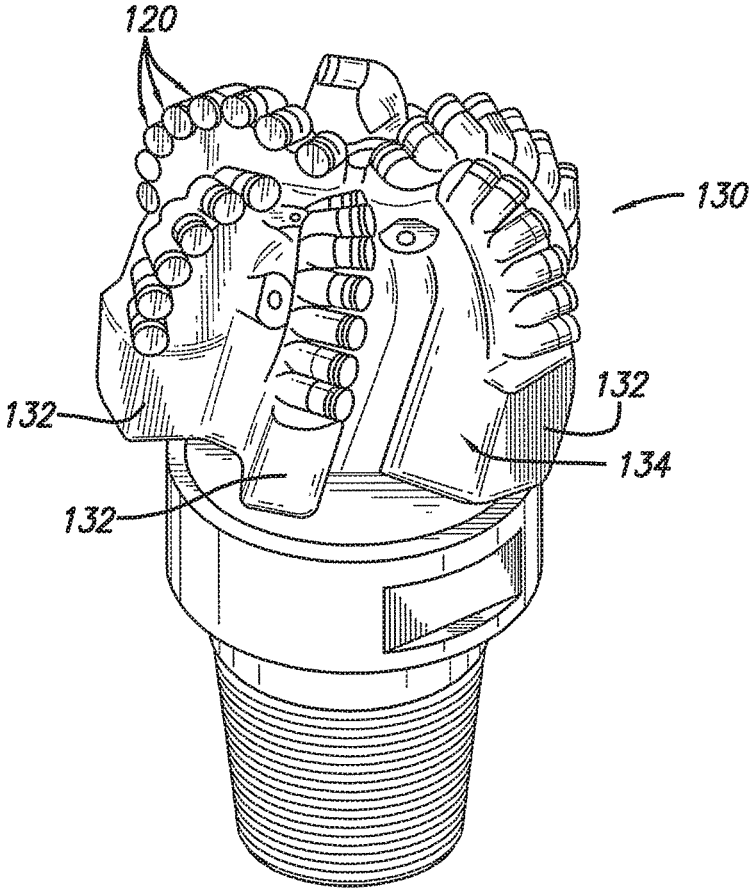
FIG. 8 is a perspective side view of a drag bit comprising a number of the shear cutters of FIG. 7.

FIG. 8 illustrates a drag bit 130 comprising a plurality of the PCD shear cutters 120 described above and illustrated in FIG. 7. The shear cutters are each attached to blades 132 that extend from a head 134 of the drag bit for cutting against the subterranean formation being drilled. Because the PCD shear cutters of this invention include a metallic substrate, they are attached to the blades by conventional method, such as by brazing or welding.

Other modifications and variations of PCD constructions, and methods for making the same, according to the principles of this invention will be apparent to those skilled in the art. It is, therefore, to be understood that within the scope of the appended claims this invention may be practiced otherwise than as specifically described.

What is claimed is:

1. A bit for drilling subterranean formations comprising a body and a number of cutting elements attached to the body, the cutting elements comprising a polycrystalline diamond construction comprising:

a diamond bonded body comprising a plurality of diamond crystals that are bonded together at high pressure/high temperature conditions of greater than 6,000 MPa, and a plurality of interstitial regions disposed between the bonded diamond crystals, the interstitial regions comprising one or more catalyst metal materials disposed therein, the diamond body comprising a working surface having a catalyst metal content of between 2 to 4 percent by weight, wherein the catalyst metal content in a remaining portion of the diamond body is greater than that of the working surface and increases in a gradient manner moving axially away from the working surface, and a metallic substrate attached to the diamond body, wherein an interface exists between the adjacent surfaces of the substrate and diamond body, and wherein the catalyst metal content within a catalyst metal depleted zone in the substrate adjacent the interface increases in a gradient manner moving axially away from the diamond body, wherein the catalyst metal content in the metal depleted zone changes less than 4 percent by weight per millimeter as measured moving axially along the substrate, and wherein the catalyst metal content within the metal depleted zone is within the range of from 4 to 16 percent by weight, wherein the diamond body includes a catalyst metal rich region that is positioned adjacent the interface, and wherein the catalyst metal content at a point in the diamond body adjacent the metal rich region is at least 3percent by weight greater than the metal catalyst content of the metal depleted zone.

2. The bit as recited in claim 1 wherein the catalyst metal content at the working surface is in the range of from 2 to 8 percent by weight, and the catalyst metal content in the remaining portion of the diamond body is in the range of from 10 to 20 percent by weight.

3. The bit as recited in claim 2 wherein the catalyst metal rich region has a catalyst metal content of from 10 to 20 percent by weight.

4. The bit as recited in claim 3 wherein the catalyst metal content at a point in the diamond body adjacent the metal rich region is greater than that at the interface by 6 percent by weight or more.

5. The bit as recited in claim 3 wherein the point in the diamond body adjacent the catalyst metal rich region is positioned at least 100 microns from the interface.

6. The bit as recited in claim 1 wherein the working surface is a peripheral edge of the diamond body, and the content of catalyst metal in the diamond body increases moving radially inwardly from the edge.

7. The bit as recited in claim 6 wherein the catalyst metal content in the diamond body increases moving axially away from the edge.

8. The bit as recited in claim 1 wherein the catalyst metal content in the metal depleted zone changes less than 3 percent by weight per millimeter as measured moving axially along the substrate.

9. The bit as recited in claim 1 wherein the one or more catalyst metal materials within the diamond body is selected from Group VIII of the Periodic table.

10. A method for making a polycrystalline diamond construction comprising the steps of:

preparing a polycrystalline diamond body by combining a volume of diamond grains and subjecting the same to high pressure/high temperature conditions of at least 6,000 MPa in the presence of a metal catalyst to form a diamond bonded body, the body comprising a plurality of bonded together diamond grains with interstitial regions disposed therebetween, wherein the metal catalyst material is disposed within the interstitial regions and wherein the amount of the metal catalyst material varies depending on location within the body, wherein the content of the metal catalyst material disposed along a working surface of the body is less than that at other locations within the body, and wherein the content of the metal catalyst material within the body increases in a gradient manner moving away from the working surface; and attaching the body to a metallic substrate, wherein the body and substrate are joined together along an interfacing adjacent surfaces, wherein the construction comprises a metal rich region disposed within the diamond body adjacent the substrate and a metal depleted region disposed within the substrate adjacent the diamond body, wherein the metal catalyst content in the metal depleted region increases in a gradient manner moving away from the diamond body and is in the range of from 4 to 16percent by weight, wherein the metal catalyst content within the metal depleted region changes less than 4 percent by weight per millimeter moving axially along the substrate, and wherein metal catalyst content in the metal rich region of the diamond body is at least 3 percent by weight greater than the metal catalyst content of the metal depleted region.

11. The method as recited in claim 10 wherein the metal content within the metal catalyst depleted region changes less than 3 percent by weight per millimeter moving axially along the substrate.

12. The method as recited in claim 10 wherein during the step of preparing, the working surface comprises a metal catalyst material content of from 2 to 8 percent by weight, and the remaining portion of the diamond body comprises a metal catalyst content of from 10 to 20percent by weight.

13. The method as recited in claim 10 wherein during the step of preparing, the working surface is formed along a peripheral edge of the body, and the content of catalyst material increases moving radially and axially away from the working surface.

14. The method as recited in claim 10, wherein the substrate comprises at least one metal catalyst content gradient prior to attaching the body.

15. The method as recited in claim 10, wherein the metal depleted region has an axial thickness of greater than 1.25 mm.

16. A method for making a polycrystalline diamond construction comprising the steps of:

combining a volume of diamond grains with a metal catalyst material and a metallic substrate, wherein a metal catalyst content of the substrate increases in a gradient manner direction moving away from an interface adjacent to the diamond grains; and subjecting the diamond grains, metal catalyst, and metallic substrate to high pressure/high temperature conditions of at least 6,000 MPa to form a diamond body joined to the metallic substrate along the interface, wherein the diamond body comprises:

a plurality of bonded together diamond grains with interstitial regions disposed therebetween;

the metal catalyst material disposed within the interstitial regions, wherein the amount of the metal catalyst material varies depending on location within the body; and a working surface opposite the interface, wherein the content of the metal catalyst material disposed along the working surface of the body is less than that at other locations within the body, and wherein the content of the metal catalyst material within the body increases in a gradient manner moving away from the working surface toward the interface; and a metal rich region adjacent the metallic substrate; and wherein after forming the diamond body the metallic substrate comprises:

a metal catalyst depleted region adjacent the diamond body, wherein the metal catalyst content in the metal depleted region increases in a gradient manner moving away from the diamond body and is in the range of from 4 to 16 percent by weight, and wherein the metal catalyst content within the metal catalyst depleted region changes less than 4 percent by weight per millimeter moving axially along the substrate, and wherein metal catalyst content in the metal rich region of the diamond body is at least 3 percent by weight greater than the metal catalyst content in the metal catalyst depleted region.

17. The method as recited in claim 16 wherein the metal catalyst content within the metal catalyst depleted region changes less than 3 percent by weight per millimeter moving axially along the substrate.

18. The method as recited in claim 16 wherein the metal catalyst depleted region has an axial thickness of greater than 1.25 mm.

* * * * *